US008851339B2

(12) United States Patent
Schultz et al.

(10) Patent No.: US 8,851,339 B2
(45) Date of Patent: Oct. 7, 2014

(54) APPLICATOR FOR SELF-ADHESIVE PRODUCTS

(75) Inventors: Jeffrey A. Schultz, Racine, WI (US); Michael E. Klinkhammer, Racine, WI (US); Steven A. Zach, Waterford, WI (US); Russell B. Wortley, Kenosha, WI (US); William J. Rice, Round Lake Beach, IL (US); Doraiswami Jaichandra, Racine, WI (US); Mark D. Duennes, Wheeling, IL (US); Keith Kristiansen, Stratford, CT (US); Jeffrey Buttler, Edgewater, NJ (US); Thomas Van Dyk, Ramsey, NJ (US); David Demar, Tenafly, NY (US); Roland Charriez, Plattekill, NY (US); John Kiely, Morris Plains, NJ (US); John Anastasiadis, Tinton Falls, NJ (US)

(73) Assignee: S.C. Johnson & Son, Inc., Racine, WI (US)

( * ) Notice: Subject to any disclaimer, the term of this patent is extended or adjusted under 35 U.S.C. 154(b) by 360 days.

(21) Appl. No.: 12/723,428

(22) Filed: Mar. 12, 2010
(Under 37 CFR 1.47)

(65) Prior Publication Data

US 2011/0033224 A1 Feb. 10, 2011

Related U.S. Application Data

(63) Continuation-in-part of application No. 12/388,588, filed on Feb. 19, 2009, now abandoned.

(51) Int. Cl.
*B67D 7/60* (2010.01)
*B65D 83/00* (2006.01)
*C11D 17/00* (2006.01)

(52) U.S. Cl.
CPC ..... *C11D 17/0056* (2013.01); *B65D 83/0005* (2013.01); *C11D 17/003* (2013.01)
USPC ..... 222/386; 222/49; 222/327; 222/524; 401/65; 401/170; 401/176

(58) Field of Classification Search
CPC . A47K 5/1201; A47K 5/1202; A47K 5/1204; A47K 5/1205; A47K 5/1207; A47K 5/1211; A47K 11/10; A47K 17/00; B65D 83/0005; B65D 83/0027; B65D 83/0011; B65D 83/0022; B65D 35/30; B65D 2231/005; B05C 17/00576; B05C 17/0116; E03D 9/00; E03D 9/002; E03D 9/005; E03D 9/02
USPC ..... 222/43, 47–50, 309, 326, 386, 327, 222/405, 524; 401/65, 77, 88, 179, 170, 401/171, 176
See application file for complete search history.

(56) References Cited

U.S. PATENT DOCUMENTS 405,521 A * 6/1889 Bailey ..... 401/65
1,393,720 A * 10/1921 Lomas et al. ..... 604/210

(Continued)

FOREIGN PATENT DOCUMENTS

DE 4134911 A1 4/1993
EP 0611035 A1 * 8/1994 ..... A61M 5/315

(Continued)

OTHER PUBLICATIONS

CRC Handbook of Chemistry and Physics, 92nd Edition, 2011-2012, p. 1-31.*

(Continued)

*Primary Examiner* — Kevin P Shaver
*Assistant Examiner* — Patrick M Buechner

(57) ABSTRACT

A device for application of a self-adhesive product, wherein the device operates with at least a first step and a second step. The first step and second step being temporally separate. A device for application of a flowable product includes a first section and a second section, the first section being sized such that at least a portion of the first section fits within the second section, the first section being slidable relative to the second section. A device includes a first section having a protrusion extending from its outer surface that fits through a slot in the second section.

20 Claims, 10 Drawing Sheets

(56) References Cited

U.S. PATENT DOCUMENTS

| | | | | |
|---|---|---|---|---|
| 2,642,606 | A * | 6/1953 | Aschenbach | 401/176 |
| 3,547,551 | A * | 12/1970 | Gruska Ralph | 401/78 |
| 3,790,048 | A | 2/1974 | Luciano et al. | |
| 4,050,459 | A * | 9/1977 | Sanchez | 604/210 |
| 4,413,760 | A | 11/1983 | Paton | |
| 4,475,905 | A * | 10/1984 | Himmelstrup | 604/208 |
| 4,832,694 | A * | 5/1989 | Raphael et al. | 604/110 |
| 4,955,747 | A | 9/1990 | Tarver | |
| 4,962,868 | A * | 10/1990 | Borchard | 222/49 |
| 5,020,693 | A | 6/1991 | Ernst et al. | |
| 5,421,663 | A | 6/1995 | Bravo | |
| 5,588,560 | A | 12/1996 | Benedict et al. | |
| 5,636,933 | A * | 6/1997 | Vizsolyi | 401/269 |
| 5,899,621 | A * | 5/1999 | Wang | 401/78 |
| 5,988,917 | A * | 11/1999 | Sheffler et al. | 401/78 |
| 6,159,181 | A | 12/2000 | Crossman et al. | |
| 6,357,945 | B1 | 3/2002 | Losier et al. | |
| 6,382,465 | B1 * | 5/2002 | Greiner-Perth | 222/82 |
| 6,615,688 | B2 | 9/2003 | Wessel | |
| 6,667,286 | B1 * | 12/2003 | Dettinger et al. | 510/191 |
| D484,755 | S | 1/2004 | Shonfeld et al. | |
| 6,701,828 | B1 | 3/2004 | Burns et al. | |
| 6,752,293 | B2 | 6/2004 | So | |
| D537,344 | S | 2/2007 | O'Brien et al. | |
| D537,722 | S | 3/2007 | Jaichandra et al. | |
| D538,164 | S | 3/2007 | Zach et al. | |
| D539,147 | S | 3/2007 | O'Brien | |
| 7,226,231 | B2 | 6/2007 | Py et al. | |
| 7,520,406 | B2 * | 4/2009 | Jaichandra et al. | 222/47 |
| D592,513 | S | 5/2009 | Zach et al. | |
| D592,527 | S | 5/2009 | Serio et al. | |
| D596,033 | S | 7/2009 | Zach et al. | |
| 2006/0167419 | A1 | 7/2006 | Fiechter et al. | |
| 2007/0007302 | A1 * | 1/2007 | Jaichandra et al. | 222/47 |
| 2008/0058239 | A1 | 3/2008 | Evers et al. | |
| 2008/0099041 | A1 | 5/2008 | Evers et al. | |
| 2008/0247805 | A1 | 10/2008 | deVirag et al. | |
| 2009/0215661 | A1 | 8/2009 | Klinkhammer et al. | |
| 2009/0215909 | A1 | 8/2009 | Wortley et al. | |

FOREIGN PATENT DOCUMENTS

| | | | |
|---|---|---|---|
| FR | 1156298 | A | 5/1958 |
| WO | 99/38788 | A1 | 8/1999 |
| WO | 03043906 | A1 | 5/2003 |
| WO | 2007/008531 | A1 | 1/2007 |

OTHER PUBLICATIONS

PCT/US2011/000448 International Search Report dated Jun. 29, 2011.

* cited by examiner

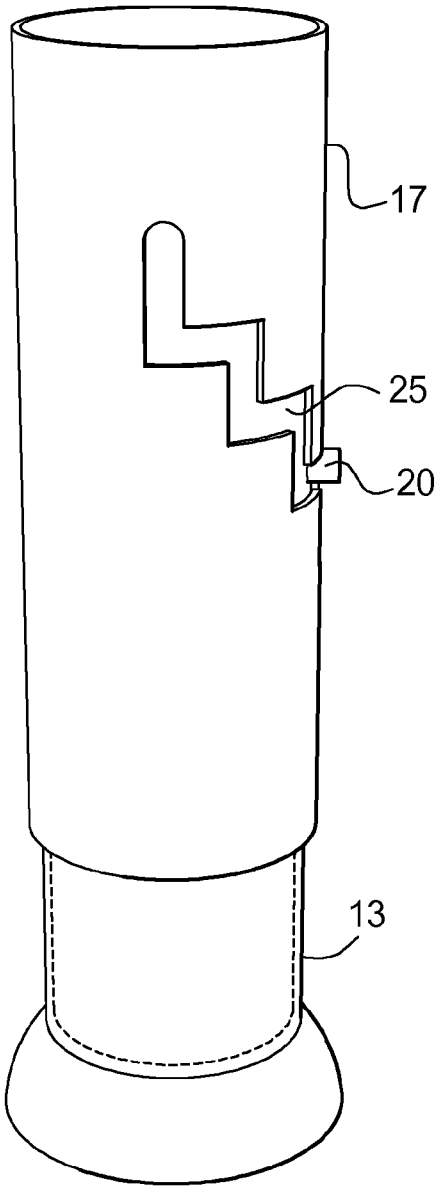
FIG. 1
FIG. 2A
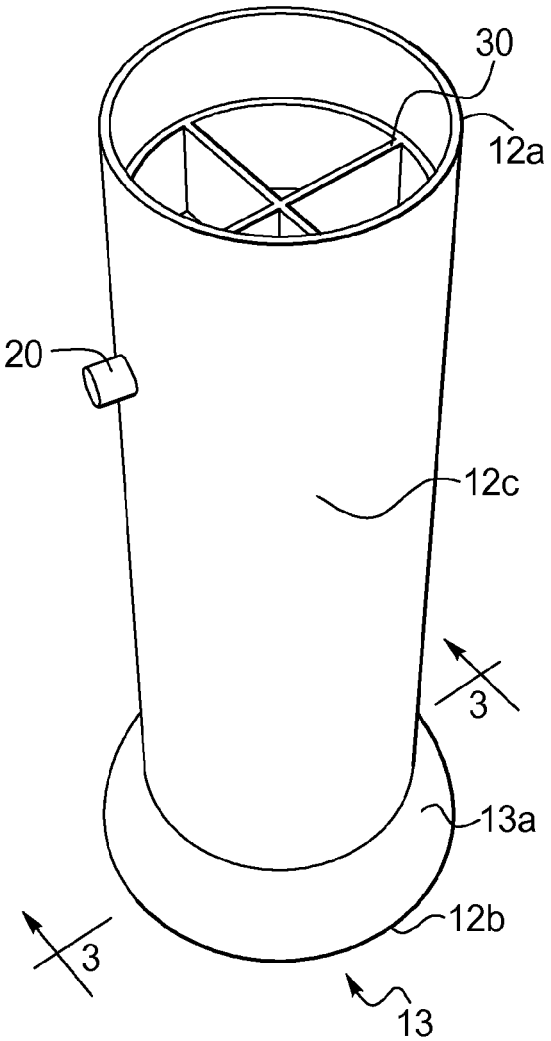

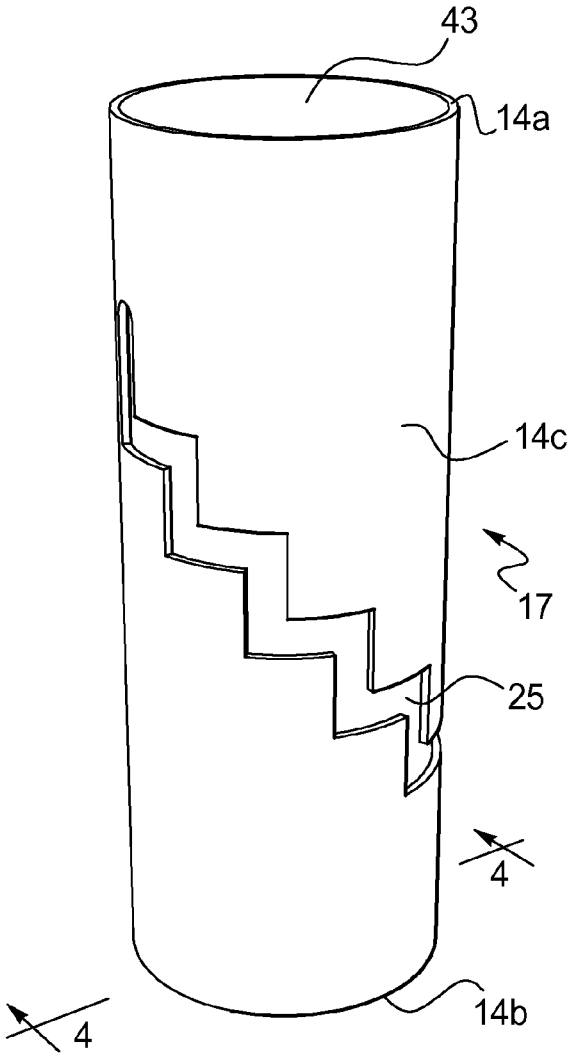
FIG. 2B
FIG. 3
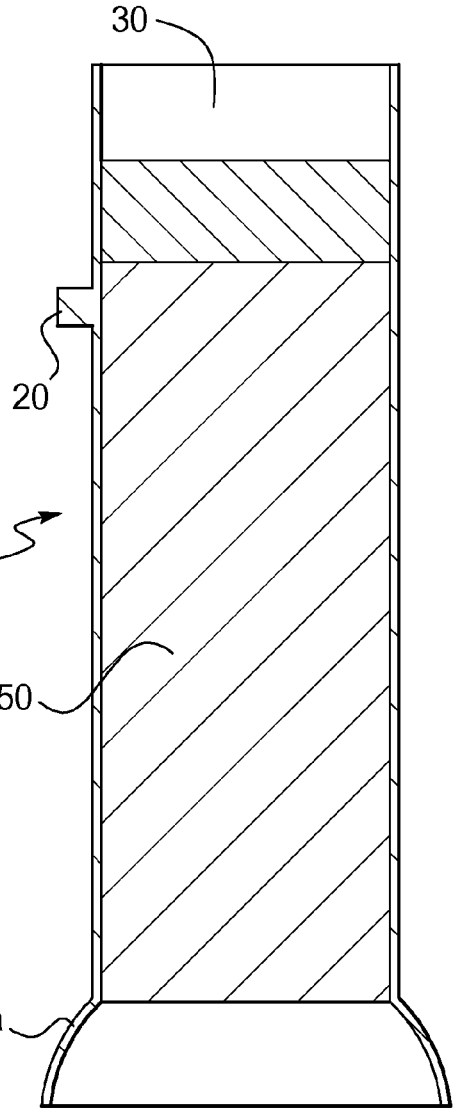

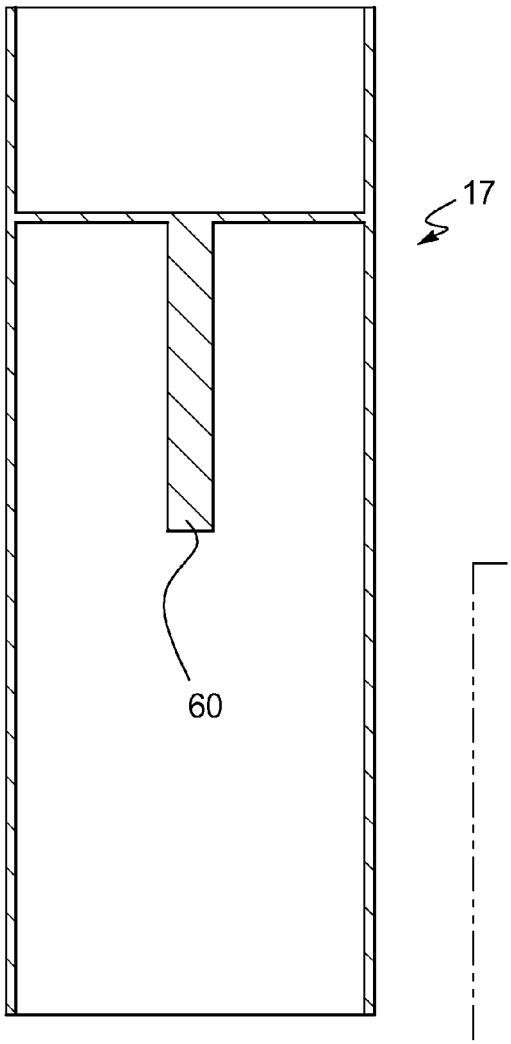
FIG. 4
FIG. 5A
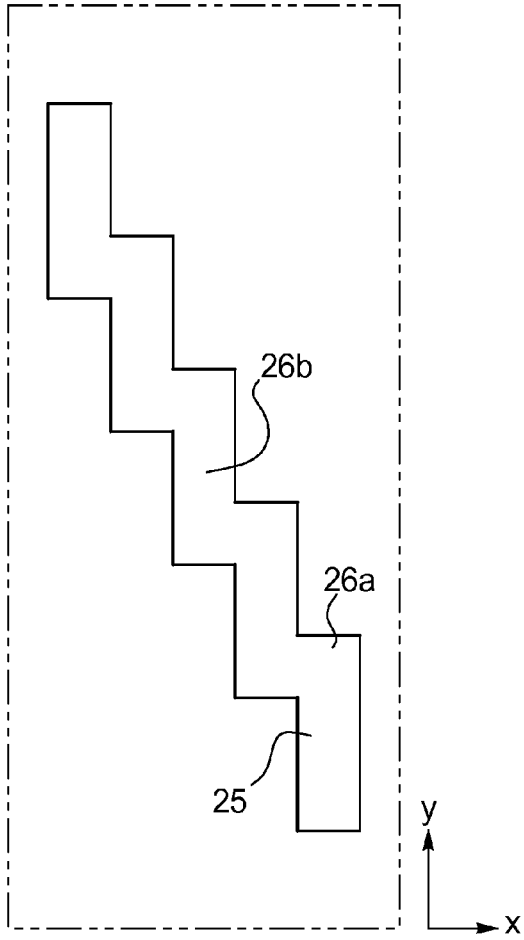

FIG. 6A
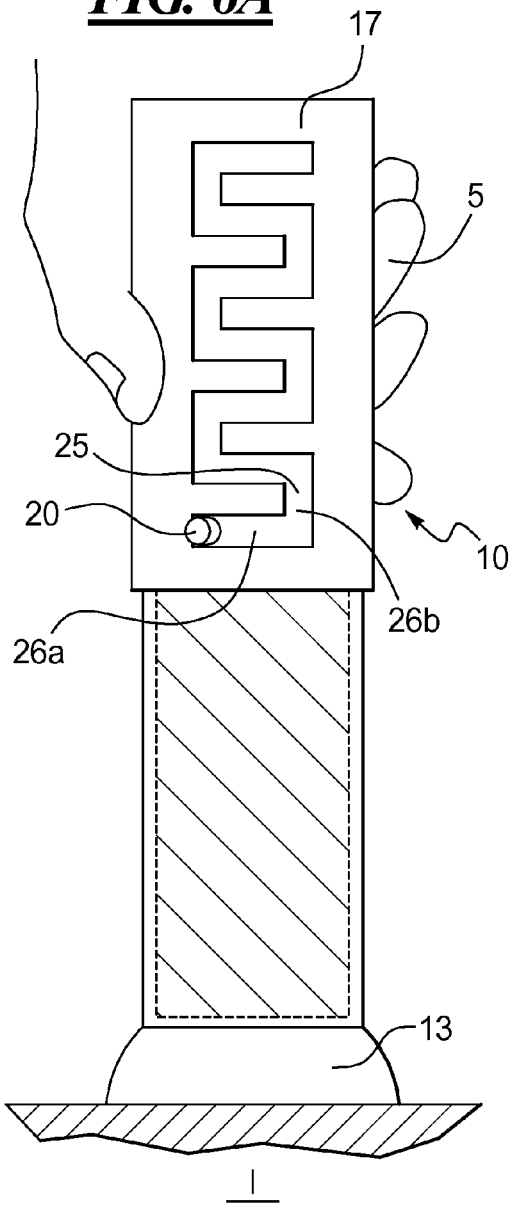
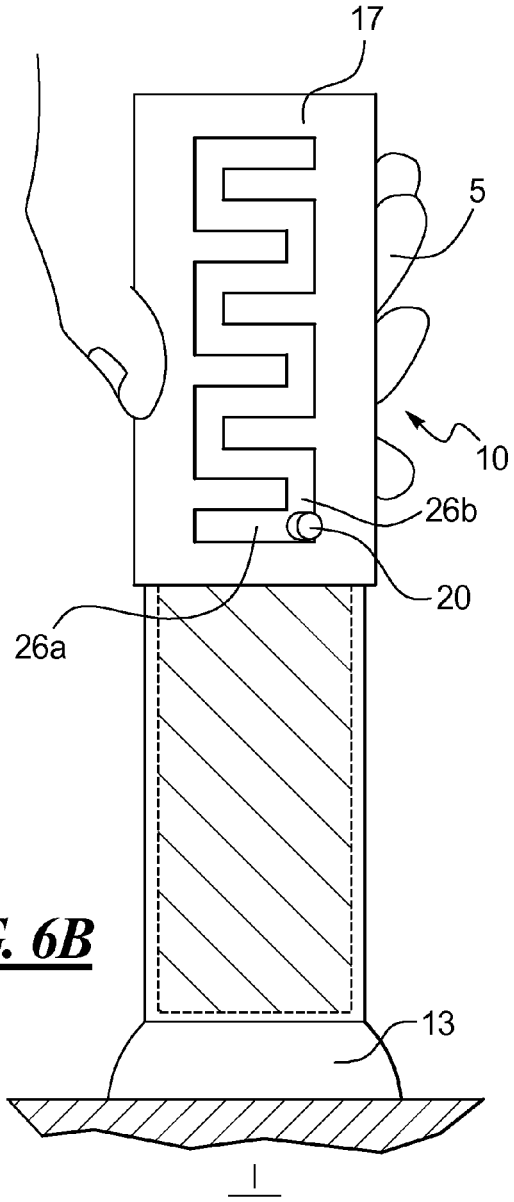
FIG. 6B

FIG. 6C
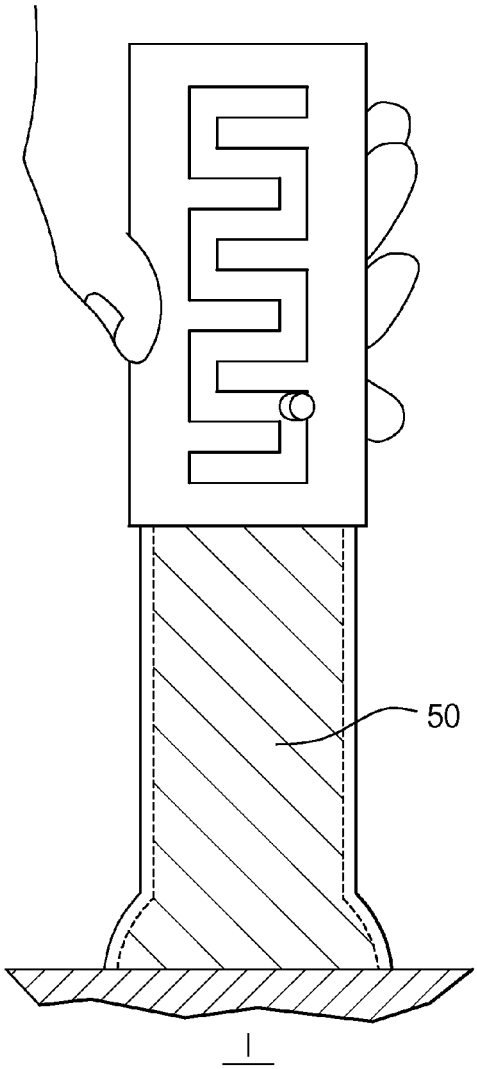
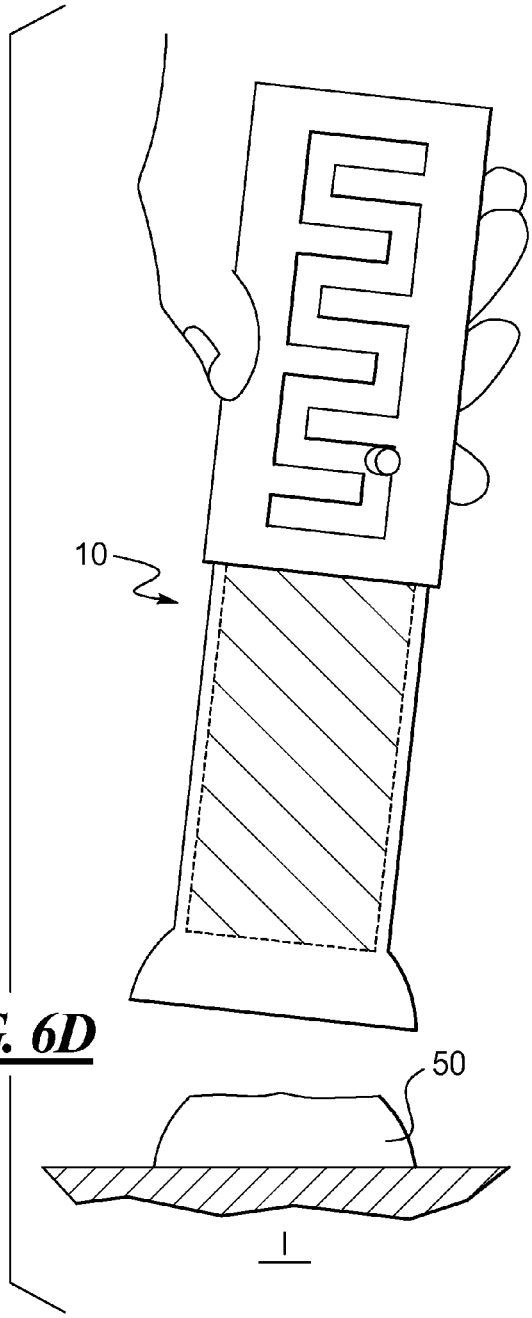
FIG. 6D

FIG. 7A
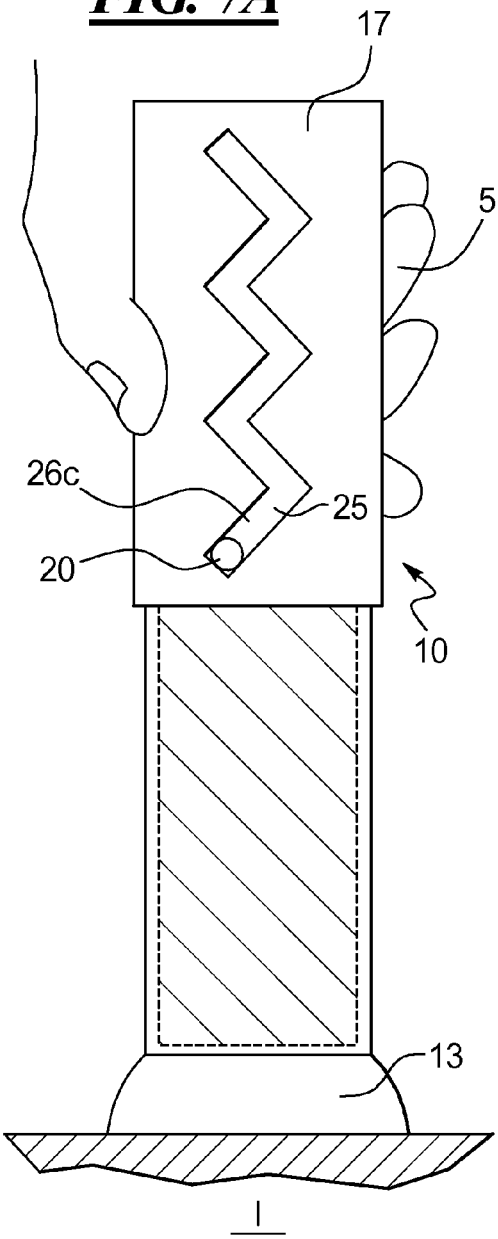
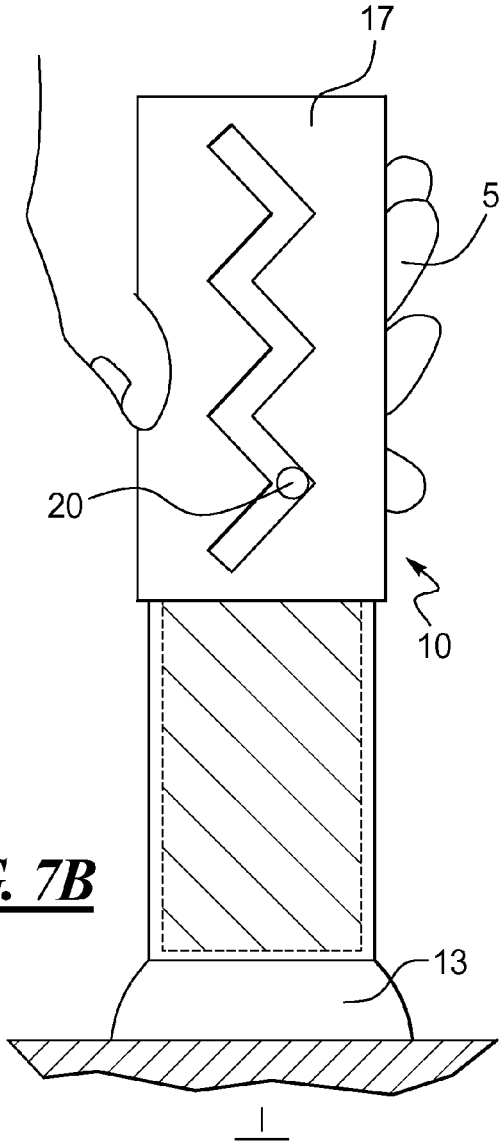
FIG. 7B

FIG. 8A
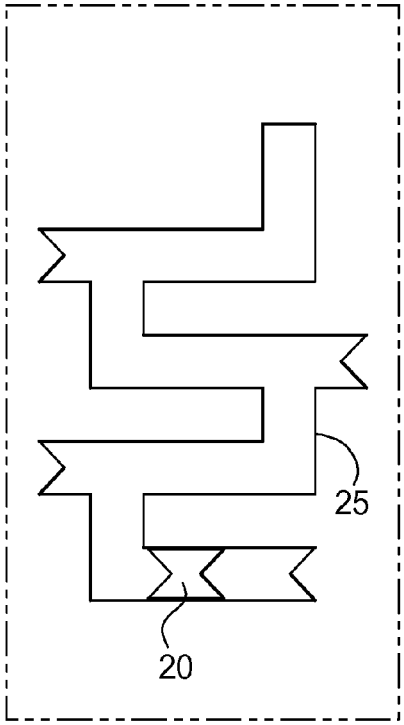
FIG. 8B
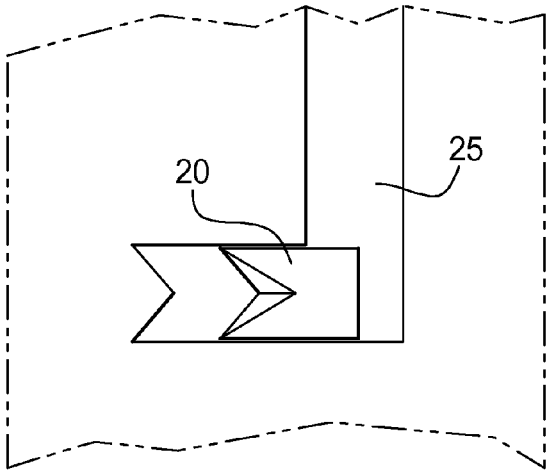
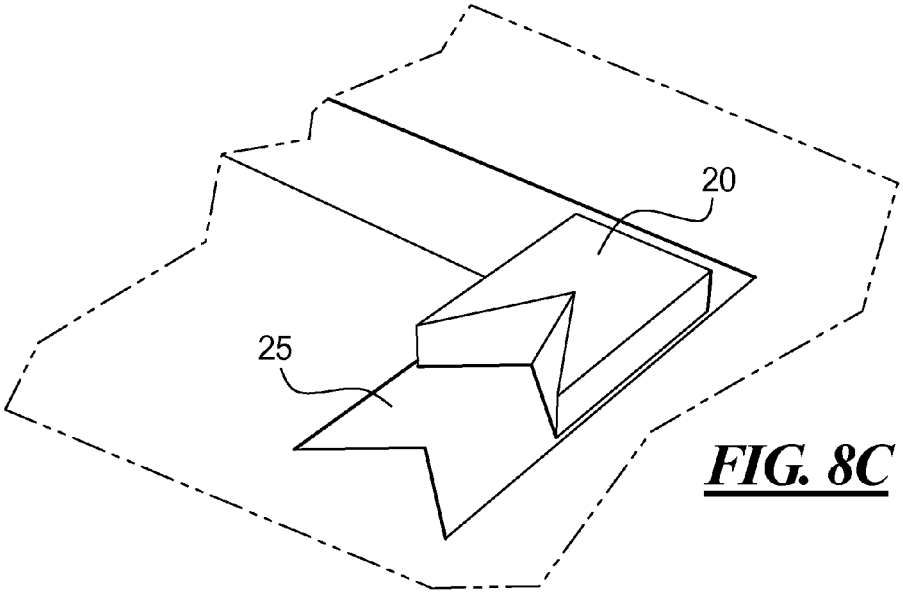
FIG. 8C

APPLICATOR FOR SELF-ADHESIVE PRODUCTS

CROSS-REFERENCE TO RELATED APPLICATIONS

This application claims the benefit of U.S. Ser. No. 12/388,588 filed Feb. 19, 2009, of which the present application is a continuation-in-part.

FIELD OF THE DISCLOSURE

In some embodiments, the present disclosure is directed to an ergonomically sensitive, and user-friendly, product applicator.

BACKGROUND OF THE DISCLOSURE

Self-adhesive compositions for use in cleaning applications are a new and exciting technology. For example, the Scrubbing Bubbles® Toilet Gel product that is manufactured and sold by S.C. Johnson & Son., Inc. (Racine, Wis.) provides users with a way to clean and freshen their toilet without the use of a cage, or other device to support it. Currently, the Toilet Gel product is dispensed using an applicator which has a button that may be depressed during a simultaneous forward pushing motion. The applicator is described in U.S. Pat. No. 7,520,406.

While achieving substantial commercial success, the inventors have surprisingly observed that this product may not have such a wide appeal as it has been discovered that some potential customers may shy away from the product due to confusion over the proper method of use of the applicator, rather than based on applicability of the gel product alone. Even more surprising, such learning comes despite the existing applicator providing a relatively uniform and consistent dose of product.

To address this newly discovered problem, an improved dispensing system is described herein.

SUMMARY OF THE DISCLOSURE

In a first nonlimiting embodiment, a device for application of a self-adhesive product may operate with at least a first step and a second step; and wherein the first step and second step have a temporal separateness.

In a second nonlimiting embodiment, a device for application of a self-adhesive product may be operated by a user, wherein: (a) the user has least one hand and one thumb on the hand; (b) the device may be operated without the user using the at least one thumb on the hand.

In a third nonlimiting embodiment, a device for application of a flowable product may include: (a) a first section; wherein the first section comprises a longitudinal axis, a bottom, a top, and an enclosed perimeter defining a first interior volume wherein a flowable product may be stored; (b) a second section; wherein the second section comprises a bottom, a top, and a substantially enclosed perimeter defining a second interior volume; wherein the first section is sized such that at least part of the first section fits within the second interior volume; (c) the first section further comprising an outer surface and a protrusion that extends from the outer surface; (d) the second section further comprises a slot in; wherein the protrusion is provided on the first section to fit through at least a portion of the slot in the second section; wherein the slot is continuous; and wherein the first section is slideable relative to the second section.

BRIEF DESCRIPTION OF THE DRAWINGS

The following detailed description of specific nonlimiting embodiments of the present disclosure can be best understood when read in conjunction with the following drawings, where like structures are indicated with like reference numerals and in which:

FIG. 1 is a perspective view of a nonlimiting embodiment of a device.

FIG. 2A is a perspective view of a nonlimiting embodiment of a first section of the device.

FIG. 2B is a perspective view of a nonlimiting embodiment of a second section of the device.

FIG. 3 is a cross-sectional view of the first section of FIG. 2A taken along line 3-3.

FIG. 4 is a cross-sectional view of the second section of FIG. 2B taken along line 4-4.

FIGS. 5A-C are top views of nonlimiting embodiments of slots.

FIGS. 6A-D provide an exemplary embodiment of a device in use.

FIGS. 7A-C provide an exemplary embodiment of a device in use.

FIGS. 8A-B provide exemplary embodiments of the slot.

DETAILED DESCRIPTION

Definitions

Figure 5B:
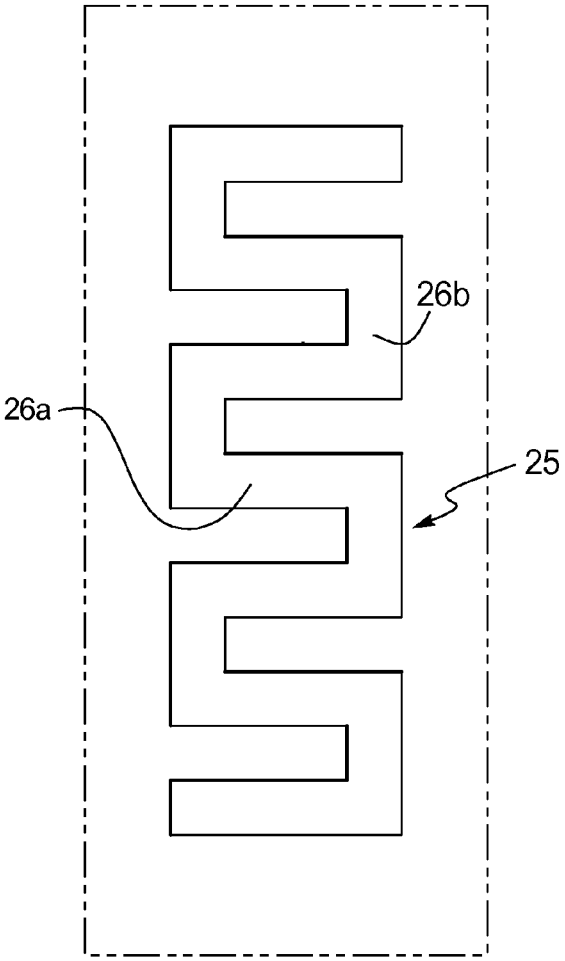

As used herein, "self-adhesive product" refers to any gel, paste, wax, solid, or the like that may be adhered to, or otherwise provide a self-support from, a surface. By self-support, it is meant that a product will not require any additional device, or other mechanical means, to maintain and/or support and/or otherwise suspend the product in a fixed place. In some embodiments, there may be gravitational forces acting against the product. For example, a product may be intended to be adhered to the side of a toilet bowl underneath the rim. In some embodiments, the surface is a ceramic surface, such as a toilet bowl or a sink. In other nonlimiting embodiments, a surface may be glass, metal, plastic, stone, and the like. In some embodiments, self-adhesive product expressly does not include a separate layer of glue. It is thought that many glues which may be used to provide a means for attachment to a surface will leave an unwanted residue behind on the surface. In some other embodiments, self-adhesive product may be washed away from the surface on which it is adhered without leaving a residue on the surface. In other embodiments, the composition of the product may be substantially uniform throughout. In one embodiment, a product may be washed away from a surface after being subject to one or more flushes.

In a particular embodiment, a self-adhesive product may comprise one or more surfactants. In other embodiments, a self-adhesive product is not required to be placed into a mechanical support unit. In other embodiments still, a self-adhesive product may be a toilet care product. An exemplary self-adhesive product that may be used for toilet care applications is the Scrubbing Bubbles® Toilet Gel product that is available from S.C. Johnson & Son, Inc. (Racine, Wis.). An exemplary mechanical support unit is described in U.S. Des. Pat. No. D423,639. A mechanical support unit may be distinguished from an applicator and/or application device ("device") because, in some embodiments, the product that is being dispensed and/or that is delivering any beneficial effect must be located within, or otherwise used in conjunction with, the support device as it is providing and/or delivering product and/or its beneficial effect.

Self-Adhesive Product: Adhesion and Use Characteristics

In a simplified exemplary embodiment, a self-adhesive product may be any product which may be affixed to a non-horizontal surface, such as the inner surface of a toilet bowl, in a first configuration without the use of a mechanical device and which may be substantially maintained in the first configuration despite exposure to an incidental force, such as from water from a flush.

In one embodiment, a self-adhesive product may be described as any product that, upon being subjected to the "Flush Resiliency Test" described herein, adheres to the surface of the toilet bowl for at least about 5 flushes. In another embodiment, a self-adhesive product adheres to the surface of the toilet bowl for more than at least about 100 flushes. In still another embodiment, a self-adhesive product adheres to the surface of the toilet bowl for more than about 500 flushes. In yet another embodiment, a self-adhesive product adheres to the surface of the toilet bowl for from about 5 flushes to about 1000 flushes. In a different embodiment still, a self-adhesive product adheres to the surface of the toilet bowl for from about 100 flushes to about 1000 flushes. In another embodiment, a self-adhesive product adheres to the surface of the toilet bowl for from about 100 flushes to about 500 flushes.

Regarding the amount of self-adhesive product that may be released or otherwise expended, in some embodiments a self-adhesive product may be one in which there is a loss of from about 0.5% to about 2% of the initial product weight per flush, according to the Flush Resiliency Test.

One of skill in the art may appreciate that the product may have an initial size, shape, weight, density, and have any product distribution, that is suitable for the intended purpose. In one nonlimiting embodiment, the self-adhesive product may have an initial weight of from about 2 g to about 15 g. In another nonlimiting embodiment, the product may have an initial weight of from about 5 g to about 10 g. In some embodiments, the self-adhesive product may have a shape selected from the group of: symmetrical, asymmetrical, round, square, star, heart, triangle, domed, circular, oblong, rectangular, octagonal, hexagonal, pentagonal, the like, and combinations thereof.

Self-Adhesive Product: Product Presentation

A self-adhesive product may be provided in any product form or state that is suitable for the intended application. In some embodiments, a self-adhesive product may be a solid. In solid form, the self-adhesive product may be the result of an extrusion. The product may be malleable. The product may be forcibly adhered to a surface. The product may have a hardness of from about 50 to about 150 tenths of a millimeter according the "Hardness Test" as described herein. An exemplary self-adhesive product in solid form is described in U.S. Pat. Pub. No. US 2008-0190457.

In other embodiments, a self-adhesive product may be a gel. The gel may be formed by a hot melt process. The gel may have a melt temperature of from about 50° C. to about 80° C. The gel may have a viscosity of from about 150,000 cps to about 400,000 cps as measured by a cone and plate viscometer. In some embodiments, a self-adhesive gel product may be able to be self-adhered to both wet and dry surfaces. An exemplary self-adhesive product in gel form is described in U.S. Pat. Pub. No. US 2009-0325839.

Product Presentation: Surface Spreading

As described supra, the disclosed compositions provide the unexpected benefit over existing compositions of, inter alia, increased mobility, active ingredient transport, and stability. Exemplary compositions are made according to the Detailed Description and are tested for surface spreading using the "Surface Spreading Test" described below.

Surprisingly, it is noticed that the addition of the surfactants provide a significant increase in transport of the compositions. In one embodiment, the compositions provide a transport rate factor of less than 55 seconds. In another embodiment, the compositions provide a transport rate factor of less than about 50 seconds. In still another embodiment, the compositions provide a transport rate factor of from about 0 seconds to about 55 seconds. In another embodiment, the compositions provide a transport rate factor of from about 30 seconds to about 55 seconds. In yet still another embodiment, the compositions provide a transport rate factor of from about 30 seconds to about 50 seconds. In still another embodiment, the compositions provide a transport rate factor of from about 30 seconds to about 40 seconds.

Product Presentation: Adhesion

In some embodiments, the products disclosed herein may adhere to a solid surface under relatively harsh conditions. It is surprisingly discovered that it may be advantageous for the product to be able to adhere to a surface for a period of at least 5 hours, as measured by the "Adhesion Test" described below. In one embodiment, a product has a minimum adhesion of greater than about 8 hours. In another embodiment, a product has a minimum adhesion of from about 8 hours to about 70 hours.

Applicator

As with the device described in U.S. Pat. No. 7,520,406, many embodiments of the present applicator 10 may be used to accurately apply controlled unitized doses of a self-adhesive composition, flowable material and/or flowable self-adhesive material, to a surface. In one example, the applicator 10 may be used for applying controlled doses of a cleaning, disinfecting and/or fragrancing flowable adhesive gel to the surface of a toilet, urinal, bathtub, shower, or the like. An exemplary self-adhesive product is described in U.S. Pat. No. 6,667,286. An alternative example of a self-adhesive product is described in WO 2009/105233. The products described in U.S. Pat. No. 6,667,286 and WO 2009/105233 may also be considered flowable. In some embodiments, a material may be considered flowable if it may be displaced by a minimum force along one or more sides and/or faces and/or portions of the material and the product. Another nonlimiting example of such a material is described in U.S. Pat. Pub. No. 2007/0007302. In the described embodiments, the product is described to have a viscosity of at least 150,000 cps (centipoise). In other embodiments, the product has a viscosity of from about 150,000 cps to about 400,000 cps.

As described herein, some embodiments disclosed herein relate to an applicator for a self-adhesive product. FIG. 1 shows one non-limiting embodiment of an applicator 10. In the embodiment that is exemplified, there is a first section 13 and a second section 17. The first section may be designed and sized such that the first section fits, or otherwise juxtaposed, within the interior volume of the second section 17. In the embodiment shown, there is a protrusion 20 that extends from the outer surface of the first section 13. The protrusion 20 may be designed and sized such that the protrusion 20 may fit through at least a portion of a slot 25 in the second section 17. In some embodiments, the slot 25 may be continuous. In other embodiments, the slot 25 may be non-linear.

FIG. 2A shows a perspective view of an exemplary embodiment of a first section 13. The first section comprises a longitudinal axis, a bottom 12*b*, a top 12*a*, and an enclosed perimeter 12*c*. The first section 13 may further comprise a protrusion 20 that extends outwardly therefrom. In the embodiment shown, the first section 13 further comprises a product guide 30 that is juxtaposed to occupy at least part of the inner volume of the first section 13 such that the product guide 30 may extends from the inner surface of the first section. The product guide 30 may be slidable such that the second section 17 or some other piece may push or otherwise initiate movement of the product guide 30 relative to the first section 13. This movement of the product guide 30 may provide one possible means to dispense gel product from the dispenser 10 (FIG. 1). A more detailed description of this sliding motion and/or interaction is described infra.

Also shown in FIG. 2A, the first section 13 may have a lip 13*a* that flares outwardly from the center of the first section 13. This lip section may be used to provide an area wherein the gel product may be formed and/or otherwise molded.

FIG. 2B shows a perspective view of the second section 17. The second section 17 comprises, inter alia, a bottom 14*b*, a top 14*a*, and a substantially enclosed perimeter 14*c* therebetween. The second section 17 further comprises a longitudinal access. The second section 17 also includes at least one slot 25 that may be sized to receive a protrusion or other means for allowing a companion component, such as a first section 13 (FIG. 2A) to be in a controlled, relative sliding relationship. In the embodiment shown, the second section 17 provides a substantially hollow internal volume 43 that may accept at least a part of the first portion 13 (FIG. 2A).

FIG. 3 shows a cross sectional view of the first section 13 of FIG. 2A taken along the line 3-3. The first section 13 comprises a lip 13*a* which may receive product 50 that is dispensed from the interior volume of the first section 13. During use, the pushing member (60, FIG. 4) may engage with the product guide 30 when the first section 13 and second section 17 are connected. For example, in an embodiment wherein the protrusion 20 from the first section 13 is aligned with the slot (25, FIG. 5A) from the second section (17, FIG. 2B) and the first section 13 and second section 17 are in a sliding relationship, then the pushing member 60 may provide a normal force (as provided by a push from a user) to the product guide 30 such that product 50 is moved from the interior volume of the first section 13 and into the interior volume of the lip area 13*a*.

FIG. 4 shows a cross sectional view of the second section 17 of FIG. 2B along line 4-4. As discussed above, in the embodiment shown the second section 17 further comprises a pushing member 60 that may engage with the product guide (30, FIG. 3) of the first section (13, FIG. 3).

Slot Design

By providing a continuous slot 25 (FIG. 1), it is thought that the dispensing of the product may be dramatically simplified because the dispenser 10 may be used in either a two-step method, or with one continuous motion, or with a "thumbs-free" operation—depending on the particular slot configuration.

FIG. 5A shows an exemplary embodiment of a slot 25. The slot is provided such that there are horizontal elements 26*a* and vertical elements 26*b*. The horizontal elements may be substantially parallel with the X-axis. It is thought that such a slot configuration allows for a relatively easy two-step application method because a user may perform a first twisting action to move a protrusion from a "locked" position, i.e., aligned such that the protrusion 20 (FIG. 1) is aligned in the y-direction with a portion of the body of the second section 17 (FIG. 1) to an "unlocked" position (i.e., aligned such that the protrusion is aligned in the y-direction with the slot 25). Once in an unlocked position, the user may apply a force to the applicator 10 to cause the first section 13 and the second section 17 to move relative to one another, the movement being substantially guided by the protrusion and slot.

In some embodiments disclosed herein, "two-step actuation" refers to an application and/or actuation process for the product requiring at least a first step that is temporally distinct from a second step. That is, a user may be able to separate the different physical motions and/or functions in the application and/or actuation process. For example, a user may not be required to depress a button (a first step) and simultaneously depress, or otherwise operate, the device (a second step).

By requiring a two-step actuation, it is thought that confusion which may occur in consumers where a simultaneous button push and device push are required for actuation (i.e., the device described in U.S. Pat. No. 7,520,406) will be avoided.

FIG. 5B shows an alternative embodiment of a slot 25. The embodiment exemplified in FIG. 5A, the slot is provided such that there are horizontal elements 26*a* and vertical elements 26*b*. The horizontal elements may be substantially parallel with the X-axis. Once in an unlocked position, the user may apply a force to the applicator 10 to cause the first section 13 and the second section 17 to move relative to one another, the movement being substantially guided by the protrusion and slot.

Figure 5C:
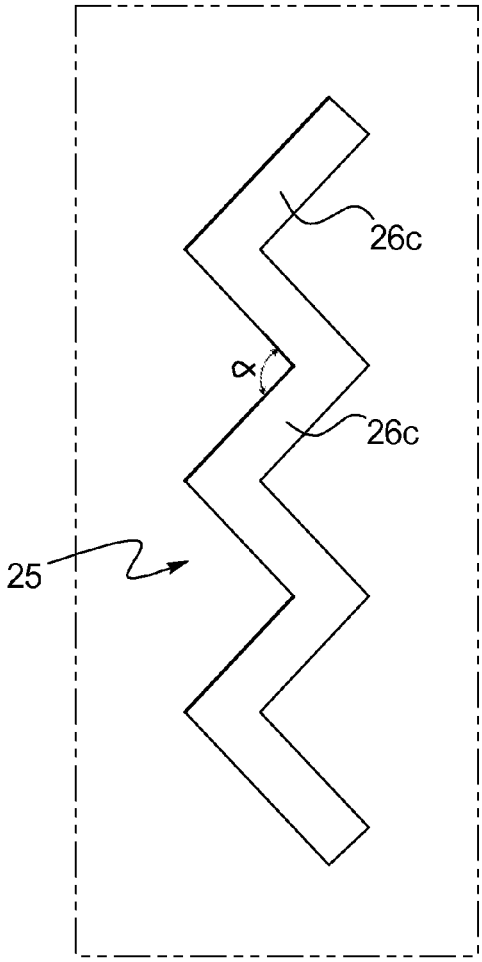

FIG. 5C shows an embodiment of a slot 25 wherein the slot 25 comprises a plurality of diagonally oriented elements 26*c*. The diagonally oriented elements 26*c* may be provided at an angle from each other such that the force and/or motion required to move from one element to another is maximized. In the embodiment shown in FIG. 5C, the diagonally oriented elements 26*c* are oriented at a relative angle $\alpha$ of about 90°. In some embodiments, the relative angle between elements (26*a-c*) may be from about 15° to about 90°. In some other embodiments, the relative angle between elements (26*a-c*) may be from about 45° to about 90°.

Slot and Protrusion Design

FIG. 8A shows an exemplary embodiment of a slot 25 and protrusion 20, wherein the slot 25 and protrusion 20 are provided with a lock-and-key configuration to prevent accidental movement of one section relative to another and which also helps to prevent the use of unauthorized refills which may not be provided with the lock-and-key configuration.

FIG. 8B shows an alternative exemplary embodiment of a slot 25 and protrusion 20, wherein the protrusion 20 is shaped such that the protrusion may be wedged underneath a coordinating portion of a horizontal section—in many embodiments, the last point of the slot 25—and thus provide for relatively easy separation of the first section from the second section.

FIG. 8C shows a perspective view of the embodiment of the protrusion 20 described in FIG. 8B. The protrusion 20 may have a sloped, or otherwise recessed, face that may be contacted with a coordinatingly keyed portion in the second section in the device.

Use of Applicator

Two-Step

As described above, one unexpected benefit of the disclosed dispensing system is that a user may be able to use the device without the use of his or her thumbs. Surprisingly, there may be a relatively high level of confusion and/or difficulty with use when using a device that requires the use of relatively fine motor skills. For example, it is surprisingly discovered that some users of a device which may require the use of a thumb to depress a button may not have the requisite strength to properly and/or easily actuate the device. Some of the embodiments disclosed herein address this issue by providing a continuous slot wherein the user simply needs to apply a force to the applicator in order to dispense any composition from the device. In the embodiments shown in FIG.

5A-C, a specifically metered dose may be provided by providing a fixed distance between vertical sections (26*b*) and/or diagonal sections (26*c*). Thus, the user may be able to actuate the device 10 (FIG. 1) with a continuous slot configuration by simply grasping the device and priming it (i.e., moving the first section relative to the second section such that the protrusion is aligned with a vertical section) and then applying a force to the device.

FIG. 6A-D provides an exemplary embodiment of such a device in use. FIG. 6A provides an exemplary device 10 as it may be held by a user 5. In the embodiment shown in FIG. 6A the device 10 is provided such that the first section 13 and the second section 17 are in a relationship such that the protrusion is set within the first possible position (starting point) within the slot 25. In the embodiment shown, the starting point is provided such that the slot is aligned in a horizontal section 26*a*. By having a horizontal section 26*a* as the starting point, the device 10 may not accidentally actuate.

FIG. 6B provides an exemplary view of the device of FIG. 6A once it has been "primed." In the exemplary embodiment the first section 13 and the second section 17 may be rotated relative to each other such that the protrusion 20 is provided in the slot 25 such that the protrusion is aligned with a vertical section 26*b*. This provides users 5 with a simple methodology by which the users 5 may "prime", or in other words prepare the device for use, in a first step.

FIG. 6C provides an exemplary view of the device of FIGS. 6A-B once it has been actuated. In the exemplary embodiment the user 5 may apply a force, which has a component that is normal to the surface, to the device 10, moving the second section 17 relative to the first section 13 and causing the product 50 to be forced from the first section 13 into contact with the surface where it may adhere. FIG. 6D provides an exemplary view of the device 10 after the second step (application of a normal force) has been performed. In the embodiment shown in FIGS. 6A-D, force is applied to the back side of the device 10.

Surprisingly, consumers who may have had difficulties with a two-part, but single step application have had a much higher level of success of properly using the product with a two-step application, as exemplified in various embodiments disclosed herein. It is thought that providing multiple parts in separate temporal units (i.e., two or more steps), the user will not be confused during use.

Single Handed, Thumbs-Free Operation

Even more surprising, it is found that an unexpected benefit of some embodiments disclosed herein is that this device may be actuated with a thumbs-free operation. That is, consumers are not required to use their thumb to depress any buttons. Especially appreciated by consumers is that a simultaneous action of depressing buttons while actuating the device.

Figure 7C:
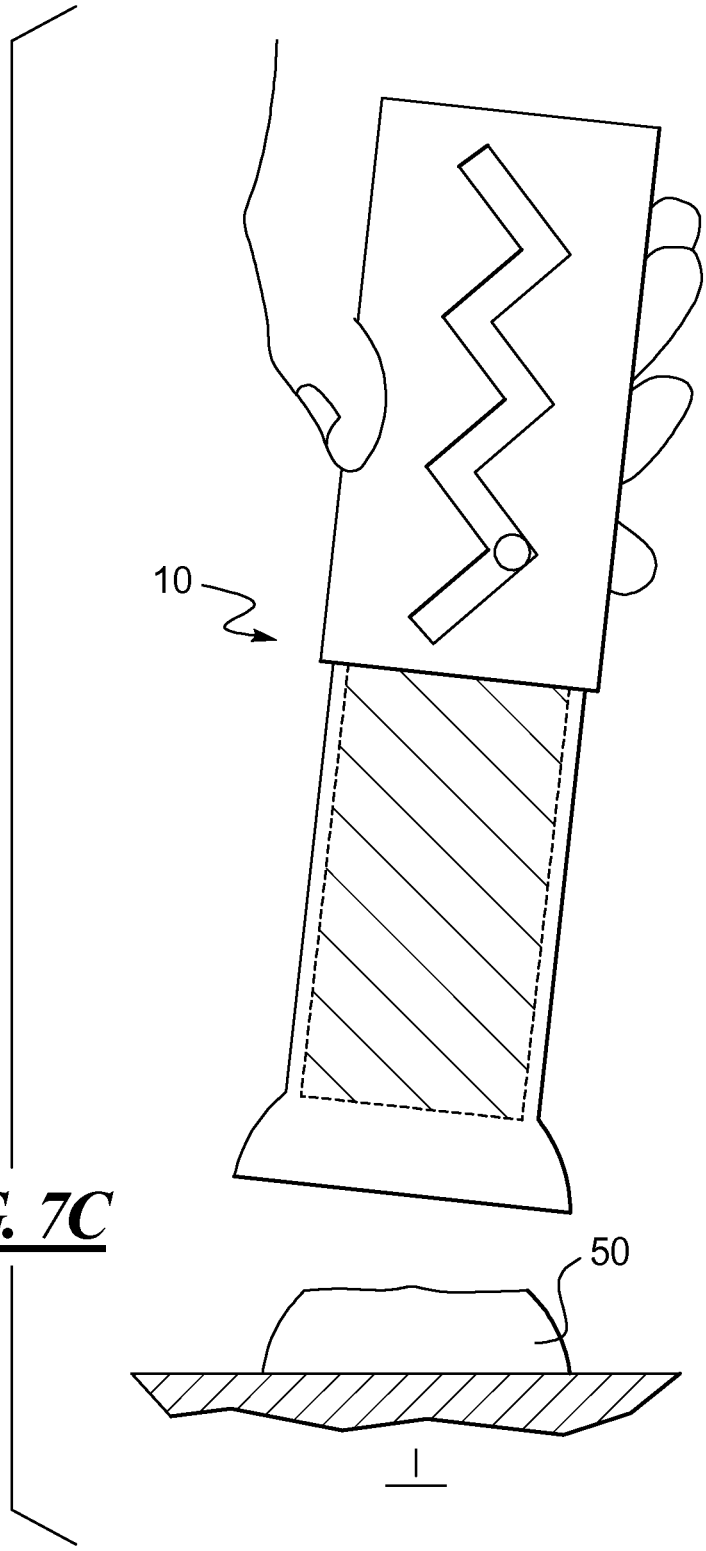

FIGS. 7A-C show an exemplary embodiment of a dispenser 10 that uses a slot 25 configuration similar to that described in FIG. 5C. In the embodiment shown in FIG. 7A, the dispenser 10 comprises a continuous slot 25, wherein the continuous slot is comprised of one or more diagonal sections 26*c*. By providing such a device, a user may, with a single pushing motion, cause the first section 13 and second section 17 to move relative to each other. In the embodiment shown, the protrusion 20 will be guided through the diagonal sections 26*c* in the slot 25 and allow one-handed operation of the device. That is, a metered dose of product may be released from the dispenser 10 upon application of a force.

One particularly surprising benefit of many of the embodiments disclosed herein is that the dispenser 10 may be used without the use of a user's thumbs. For example, in embodiments requiring a two-step application, there may not be the need for a user to use the thumbs on her hands to implement the first and/or second step and/or any other steps which may be required for proper actuation.

Similarly, in embodiments wherein a single motion is required to actuate the device 10, a user may not be required to use the thumbs on her hands to actuate the device 10.

Use of Applicator: Section Size Considerations

Figure 9:
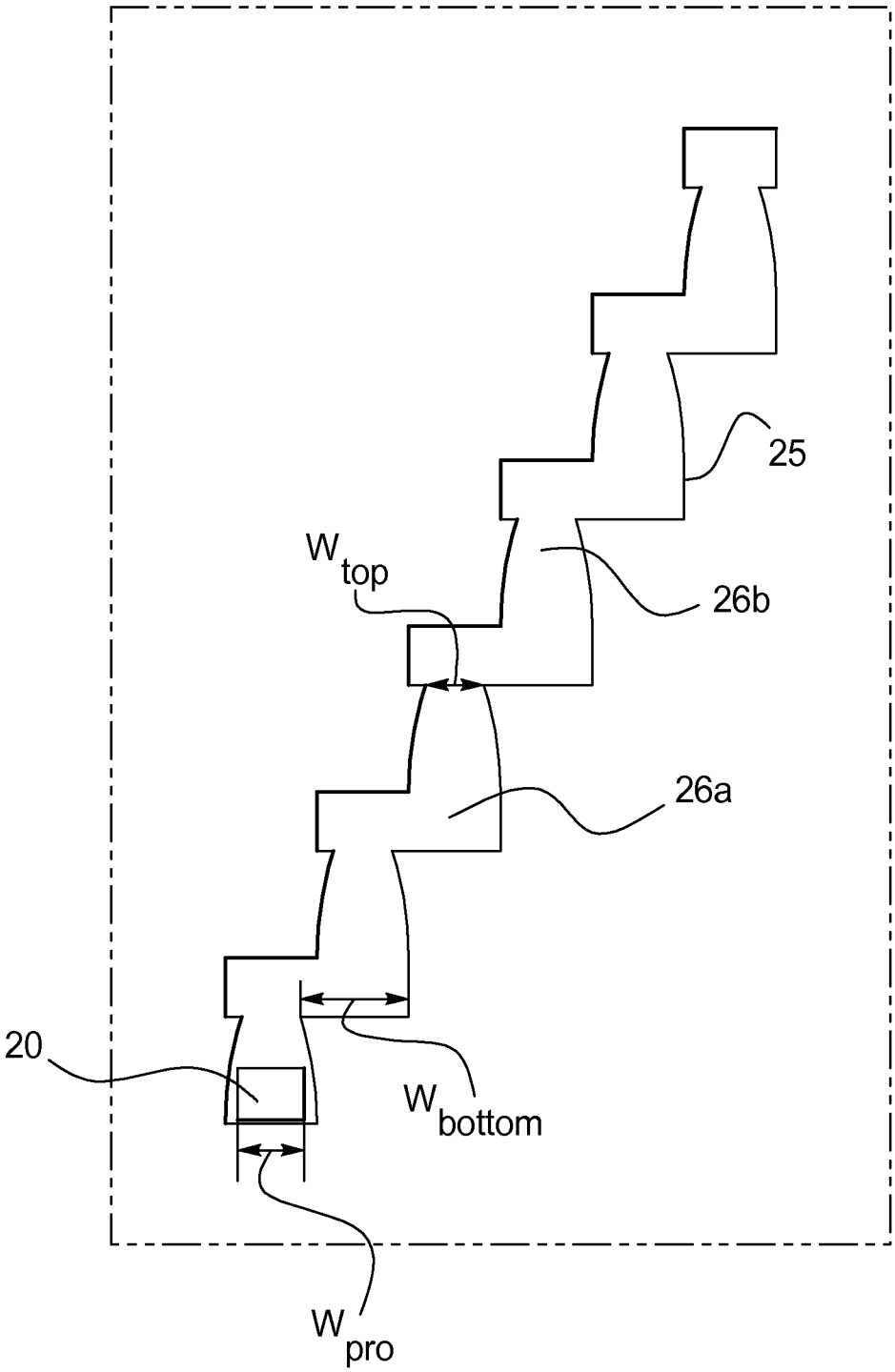
FIG. 9 provides an exemplary embodiment of the slot.

FIG. 9 shows a nonlimiting exemplary embodiment of a slot 25 having horizontal sections 26*a* and vertical sections 26*b*. The vertical sections 26*b* in the embodiment shown are of a variable width. In one embodiment, the protrusion 20 may have a width ($W_{pro}$) that is smaller than the width of the bottom end of a vertical section 26*b* ($W_{bottom}$). The width of the protrusion ($W_{pro}$) may be larger than the width of the top end of the vertical section $W_{top}$. In practice, a user will be required to provide a minimum amount of force to cause the protrusion 20 to be forced through the top end of a vertical section 26*b* as the material for the device may be selected such that there is some flexibility around the sections 26*a, b*. In a particular embodiment, the vertical section 26*b* may be provided such that the vertical sides are concave relative to the protrusion 20. The concavity provides for relative smooth and even flexing of the device as the protrusion is pushed through a vertical section 26*b*. Further, when the protrusion 20 is moved from a starting position to an ending position, the device makes a "click" sound or some sort of audible cue.

Test Methods

Flush Resiliency Test

A high volume toilet bowl (American Standard Cadet Model, American Standard, Piscataway, N.J.) attached to a standard plumbing set-up is used. A water temperature of about 80° F. is used. The water has a "medium" hardness of about 120 ppm $CaCo_3$. About 7 to about 10 g of product is metered out and the initial weight is recorded. The product is then adhered to the inner surface of the toilet bowl, about 2 inches below the upper rim. The toilet is flushed 72 times at approximately equal intervals, approximately every 96 minutes. The remaining product is removed about 30 minutes after the final flush and the weight of the remaining product is recorded. The difference between the final and initial weight is measured and recorded and then divided by the number of flushes. The resultant number is recorded as the "loss per flush". The "loss per flush" may then be divided by the initial weight. The resultant number may be reported as the "loss of initial product weight per flush."

Hardness Test

The method used to assess the hardness of a cleansing block is the "Hardness Test". The hardness measurement is in tenths of a millimeter penetration into the surface of an extrudate. Therefore, a measurement of 150 is a penetration of 150 tenths of a millimeter, or 15 millimeters. The equipment used 20 was a Precision Penetrometer (Serial #10-R-S, Manufactured by Precision Scientific Co., Chicago, Ill., USA) equipped with a large diameter cone weighing 102.4 grams with a 23D angle, and loaded with 150 grams of weight on the top of the spindle. The test method steps were: (1) Sample must be at least 'X' inches thick. (2) Place sample on the table of the instrument. (3) Both top and bottom 25 surfaces of the test sample should be relatively flat. (4) Set scale on instrument to ZERO and return cone and spindle to the upward position and lock. Clean any residual material off the cone and point before resetting for the next reading. (5) Using hand wheel, lower the complete head of the instrument with cone downward until the point of the cone touches the surface of the sample. (6) 30 Recheck the ZERO and pinch the release of the cone and spindle. (7) Hold the release handle for the count of 10 seconds and release the handle. (S) Read the dial number and record. (9) Repeat steps 4-S three times at different locations on the surface of the test sample. (10) Add the 3 recorded numbers and divide by 3 for the average. This result is the hardness of the tested sample.

With this "Hardness Test", a higher number indicates a softer product because the units of hardness are in tenths of a millimeter in penetration using the 5 test procedure delineated above. If the cleansing block is too soft (i.e., a high hardness number), then it is difficult to manufacture into shapes such as blocks because the product is too malleable. If the product is too hard (i.e., a low hardness number), then more pressure is required to push the cleansing block onto the surface, and some stickiness is lost. Typically a hardness of from about 20 to about 160 tenths of a millimeter penetration may be preferred for a cleansing block that will be applied to a dry surface. Typically a hardness of greater than 50 tenths of a millimeter penetration may be preferred for a cleansing block that will be applied to a wet surface.

Adhesion Test

The ability of a composition to adhere to an exemplary hard surface is measured as described below. A workspace is provided at a temperature of from about 86° F. to about 90° F. The relative humidity of the workspace is set to from about 40% to about 60%.

A board comprising twelve 4.25"×4.25" standard grade while glossy ceramic tiles arranged in a 3 (in the y-direction)×4 (in the x-direction) configuration (bonded and grouted) to a plexi-glass back is provided.

The board is rinsed with warm (about 75° F. to about 85° F.) tap water using a cellulose sponge. The board is then re-rinsed thoroughly with warm tap water. A non-linting cloth (ex. Kimwipe®, Kimberly Clark Worldwide, Inc., Neenah, Wis.) saturated with isopropanol is used to wipe down the entire tile board.

The board is juxtaposed to be in a horizontal position (i.e., such that the plane of the board is flat on the floor or lab bench).

Samples approximately 1.5" in diameter and weighing from about 5.5 g to about 8.0 g are provided to the surface of the board such that the bottom of the sample touches the top-most, horizontally oriented (i.e., in the x-direction), grout line of the board. Samples are spaced approximately 2" apart from each other. A permanent marker is used to draw a straight line (parallel to the x-direction) approximately 0.75" below the top-most grout line.

The board is juxtaposed to then be in the vertical position (i.e., such that the plane of the board is perpendicular with the floor or lab bench). A timer is started as the board is moved to the vertical position. The time that a sample takes for the sample to slide down the tile a distance of about 1.5 times the diameter of the sample is measured, recorded as the "sample adhesion time."

Surface Spreading Method

The "transport rate factor" is measured as described below.

A 12"×12" pane of frosted or etched glass is mounted in a flat-bottomed basin that is large enough to support the pane of glass. The basin is provided with a means for drainage such that water does not accumulate on the surface of the pane of glass as the experiment is performed at a room temperature of approximately 22° C. in ambient conditions. The pane of glass is supported on top of the bottom of the basin of water using 4"×4" ceramic tiles—one tile at each side of the bottom edge of the pane. The middle 4 inches of the pane is not touching the bottom, so that water can run down and off the glass pane. The pane of glass is juxtaposed such that pane of glass is at an angle of approximately 39° from the bottom of the basin.

The glass pane is provided with 0.5 inch measurement markers from a first edge to the opposing edge.

A glass funnel (40 mm long×15 mm ID exit, to contain >100 ml) is provided approximately 3.5" over the 9" mark of the pane of glass.

The pane of glass is cleaned with room temperature water to remove trace surface active agents. The cleaned pane of glass is rinsed until there is no observable wave spreading on the pane.

A sample of approximately 7 g. (approximately 1.5" diameter circle for gels) of composition is applied to the pane of glass at the 0 mark. Four beakers (approximately 200 mL each) of water (are slowly poured over the top of the glass pane at the 9" height point and is allowed to run down the pane of glass to condition the composition.

After about one minute, the funnel is then plugged and is provided with approximately 100 mL of water. An additional 100 mL of water is slowly poured onto the glass pane at approximately the 9" marker. After approximately 10 seconds, the stopper is removed and a timer is started as the water in the funnel drains onto the pane of glass.

A wave on the surface of the draining water film above the composition is observed to creep up the glass and the time for the composition to reach the 5" marker is recorded.

The test is repeated for 10 replicates and the time in seconds is averaged and reported as the "transport rate factor" (time in seconds).

The exemplary embodiments herein disclosed are not intended to be exhaustive or to unnecessarily limit the scope of the claims. The exemplary embodiments were chosen and described so that others skilled in the art may practice the claimed subject matter. As will be apparent to one skilled in the art, various modifications can be made within the scope of the aforesaid description. Such modifications being within the ability of one skilled in the art are intended to fall within the scope of the appended claims.

It is noted that terms like "specifically," preferably," "typically," "generally," and "often" are not utilized herein to limit the scope of the claims or to imply that certain features are critical, essential, or even important to the structure or function of the claimed subject matter. Rather, these terms are merely intended to highlight alternative or additional features that may or may not be utilized in a particular embodiment disclosed herein. It is also noted that terms like "substantially" and "about" are utilized herein to represent the inherent degree of uncertainty that may be attributed to any quantitative comparison, value, measurement, or other representation.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "50 mm" is intended to mean "about 50 mm."

We claim:

1. A device for application of a self-adhesive product, comprising:

a first section having an enclosed perimeter defining a first interior volume wherein the self-adhesive product may be stored, a bottom from which the self-adhesive product is directly dispensed and a protrusion extending from the enclosed perimeter;

a second section having a perimeter and defining a second interior volume and a continuous, non-linear slot through which the protrusion extends;

at least one sloped face on the protrusion for interlocking with a complementary portion of the slot in a wedging configuration; and wherein the device operates to successively apply the self-adhesive product with the rotation of the entire second section relative to the first section in at least two different directions.

2. A device according to claim 1 wherein the self-adhesive product is a cleaning product.

3. A device according to claim 1 wherein the self-adhesive product has a viscosity of at least 150,000 centipoise.

4. A device according to claim 1 wherein the device operates to apply the self-adhesive product with movement of the second section relative to the first section in a longitudinal direction.

5. A device according to claim 4 wherein movement of the second section relative to the first section in the longitudinal direction releases the self-adhesive product from the device.

6. A device according to claim 1 wherein the slot comprises diagonally oriented elements.

7. A device according to claim 6 wherein the diagonally oriented elements are at a relative angle from 15° to 90°.

8. A hand-held device for application of a self-adhesive product, comprising:

a first section having an enclosed perimeter defining a first interior volume wherein the self-adhesive product may be stored, a bottom from which the self-adhesive product is directly dispensed and a protrusion extending from the enclosed perimeter;

a second section having a perimeter and defining a second interior volume and a continuous, non-linear slot through which the protrusion extends;

wherein the protrusion and slot have complementary interlocking configurations including at least one sloped face on the protrusion for interlocking with a complementary portion of the slot in a wedging configuration;

wherein the device is actuated by a thumb-free operation; and wherein the first and second sections are slidable relative to one another and in more than one direction to apply the self-adhesive product.

9. A device according to claim 8 wherein the self-adhesive product is a cleaning product.

10. A device according to claim 8 wherein the self-adhesive product has a viscosity of at least 150,000 centipoise.

11. A device for application of a flowable product, the device comprising:

a first section including a longitudinal axis, a bottom from which the flowable product is dispensed, a top, and an enclosed perimeter defining a first interior volume wherein the flowable product may be stored, the first section further comprising an outer surface and a protrusion that extends from the outer surface;

a second section including a bottom, a top, and a perimeter defining a second interior volume, wherein the first section is sized such that at least part of the first section fits within the second interior volume, the second section further comprising a slot;

wherein the protrusion is provided on the first section to fit through at least a portion of the slot in the second section;

wherein the slot is continuous;

wherein the entire first section is slidable in at least two directions relative to the entire second section to successively apply the flowable product;

wherein the protrusion is displaced through the second section from a bottom end of the slot towards a top end of the slot when applying the flowable product; and wherein the protrusion includes at least one sloped face for interlocking with a complementary portion of the slot in a wedging configuration.

12. A device according to claim 11 wherein the slot is non-linear.

13. A device according to claim 12 wherein the non-linear slot comprises elements, the elements being juxtaposed at a relative angle of from 15° to 90°.

14. A device according to claim 13, wherein the relative angle is from 45° to 90°.

15. A device according to claim 13, wherein the elements have the same length.

16. A device according to claim 13, wherein every other element has the same length.

17. A device according to claim 11 wherein the first section further comprises a lip that flares outwardly from the center of the first section.

18. A device according to claim 11 wherein the second section further comprises a pushing member that is attached to an inner facing surface of the perimeter of the second section and comprises an elongated member that extends through at least a portion of the second interior volume.

19. A device according to claim 18 wherein the first section further comprises a product guide, the product guide is movably positioned within an inner surface of the enclosed perimeter of the first section, and wherein the product guide and pushing member are provided such that the product guide may engage the pushing member.

20. A device according to claim 19 wherein the flowable product is stored in the first interior volume of the first section, the flowable product being stored on the opposite side of the product guide that engages the pushing member.

* * * * *